US006739801B2

(12) United States Patent
Dreyer

(10) Patent No.: US 6,739,801 B2
(45) Date of Patent: May 25, 2004

(54) BOOM CURTAIN WITH ZIPPER CONNECTIONS AND METHOD OF ASSEMBLING BOOM

(75) Inventor: Harold B. Dreyer, Anchorage, AK (US)

(73) Assignee: Gunderboom, Inc., Anchorage, AK (US)

( * ) Notice: Subject to any disclaimer, the term of this patent is extended or adjusted under 35 U.S.C. 154(b) by 0 days.

(21) Appl. No.: 10/270,798

(22) Filed: Oct. 11, 2002

(65) Prior Publication Data

US 2003/0072616 A1 Apr. 17, 2003

Related U.S. Application Data

(60) Provisional application No. 60/328,757, filed on Oct. 11, 2001.

(51) Int. Cl.[7] ..... E02B 15/04

(52) U.S. Cl. ..... 405/70; 405/63

(58) Field of Search ..... 405/63, 64, 70, 405/72; 210/923, 242.1, 242.3; 441/65

(56) References Cited

U.S. PATENT DOCUMENTS

| | | | | |
|---|---|---|---|---|
| 3,659,713 | A | | 5/1972 | Mueller |
| 3,710,577 | A | * | 1/1973 | Matheson ..... 405/64 |
| 3,713,540 | A | | 1/1973 | Davidson et al. |
| 3,868,824 | A | * | 3/1975 | Thurman ..... 405/71 |
| 3,979,289 | A | | 9/1976 | Bykowski et al. |
| 4,178,245 | A | | 12/1979 | Nakaoka et al. |
| 4,201,495 | A | * | 5/1980 | Preus ..... 405/63 |
| 4,219,423 | A | | 8/1980 | Smith, Jr. |
| 4,288,321 | A | | 9/1981 | Beane |
| 4,296,884 | A | | 10/1981 | Luebke |
| 4,419,232 | A | | 12/1983 | Arntyr et al. |
| 4,582,048 | A | | 4/1986 | Sorensen |
| 4,669,972 | A | | 6/1987 | Koblanski |
| 4,692,059 | A | | 9/1987 | Juutilainen |
| 4,749,479 | A | | 6/1988 | Gray |
| 4,880,333 | A | | 11/1989 | Glasser et al. |
| 4,919,820 | A | | 4/1990 | Lafay et al. |
| 5,102,261 | A | | 4/1992 | Gunderson, III |
| 5,197,821 | A | | 3/1993 | Cain et al. |
| 5,220,958 | A | | 6/1993 | Bernhardt |
| 5,225,622 | A | | 7/1993 | Gettle et al. |
| 5,322,629 | A | | 6/1994 | Stewart |
| 5,345,741 | A | | 9/1994 | Slater et al. |
| 5,354,456 | A | | 10/1994 | Montgomery et al. |
| 5,354,459 | A | | 10/1994 | Smith |
| 5,372,711 | A | | 12/1994 | Sill |
| 5,394,786 | A | | 3/1995 | Gettle et al. |
| 5,427,679 | A | | 6/1995 | Daniels |
| 5,538,359 | A | * | 7/1996 | Wadle et al. ..... 405/70 |
| 5,558,462 | A | | 9/1996 | O'Haver |
| RE36,297 | E | | 9/1999 | Heino et al. |
| 5,992,104 | A | | 11/1999 | Hudak |
| 2002/0080681 | A1 | | 6/2002 | Dreyer et al. |

FOREIGN PATENT DOCUMENTS

| | | |
|---|---|---|
| FR | 2195-238 | 8/1972 |
| FR | 2284-709 | 9/1974 |
| FR | 2329-808 | 11/1975 |
| FR | 2579-239 A | 3/1985 |
| GB | 2 246 981 A | 2/1992 |
| WO | WO 91/07546 | 5/1991 |
| WO | WO 99/19570 | 4/1999 |

* cited by examiner

*Primary Examiner*—Heather Shackelford
*Assistant Examiner*—Lisa Saldano
(74) *Attorney, Agent, or Firm*—Nixon Peabody LLP

(57) ABSTRACT

Modular boom curtain sections are disclosed, including zipper elements for connection of adjacent modular boom curtain sections. Boom curtains assembled from the boom curtain sections, boom systems containing those boom curtains, and methods of assembling the boom systems are also disclosed.

66 Claims, 7 Drawing Sheets

BOOM CURTAIN WITH ZIPPER CONNECTIONS AND METHOD OF ASSEMBLING BOOM

This application claims the priority benefit of U.S. Provisional Patent Application Serial No. 60/328,757 filed Oct. 11, 2001, which is hereby incorporated by reference in its entirety.

FIELD OF THE INVENTION

The present invention relates to a boom curtain which includes readily detachable/attachable component portions or sections which can be used to assemble a boom curtain having a desired configuration, as well as a containment/exclusion booms containing such a boom curtain and methods for assembling the same.

BACKGROUND OF THE INVENTION

Containment/exclusion booms can be used to filter water or to restrict the flow of debris and contaminants from one side of the boom to the other. Such contaminants can include any debris or marine or aquatic life, as well as silt which is laden with bacteria. Because containment/exclusion booms are used in bodies of water where some degree of contamination exists, it is a common problem to have fouling of the boom curtain fabric. This fouling sometimes requires the boom to be removed from the site in its entirety and another boom installed. This is time consuming and expensive. Containment/exclusion booms can also be installed where boat and ship traffic can cause damage. It would be very beneficial, therefore, to be able to replace these fouled, contaminated, or damaged sections of the containment/exclusion boom on site, either while still deployed in the marine environment or after the boom has been removed from the body of water but still at the deployment location.

The present invention overcomes these and other deficiencies in the art.

SUMMARY OF THE INVENTION

A first aspect of the present invention relates to a boom curtain section formed of one or more sheets of flexible material that allow the flow of water therethrough, the one or more sheets of flexible material having an upper edge, a lower edge, and opposed lateral edges; and a first zipper element secured to the one or more sheets of flexible material adjacent a portion of the length of both lateral edges, wherein the first zipper element adjacent one or both lateral edges is disposed for mating engagement with a corresponding zipper element adjacent a lateral edge of an adjoining curtain section.

A second aspect of the present invention relates to a boom curtain including two or more curtain sections according to the first aspect of the present invention, wherein the zipper element adjacent a lateral edge of each curtain section is engaged with a corresponding zipper element adjacent a lateral edge of an adjoining curtain section.

A third aspect of the present invention relates to a boom system including a boom curtain according to the second aspect of the present invention. Specifically, the boom system can include a support system which can be positioned in a body of water, wherein the upper edge of the two or more curtain sections are connected to the support system; and means, connected to the lower edge of the two or more curtain sections, for maintaining at least the lower edges thereof substantially against the floor of a body of water upon introduction of the boom system into the body of water.

A fourth aspect of the present invention relates to a method of assembling a boom system that includes: assembling a boom curtain according to the second aspect of the present invention by connecting together mating zipper elements from adjoining curtain sections; connecting the upper edge of each curtain section to a support system which can be positioned in a body of water; and connecting the lower edge of each curtain section to means for maintaining at least the lower edges thereof substantially against the floor of a body of water upon introduction of the boom system into the body of water.

A fifth aspect of the present invention relates to an upper boom curtain section that includes: one or more sheets of flexible material that allow the flow of water therethrough, the one or more sheets of flexible material having an upper edge, a lower edge, and opposed lateral edges, the upper edge being adapted and configured for connection to a support system, and zipper elements secured to the one or more sheets of flexible material adjacent a portion of the length of both lateral edges and the lower edge, wherein each of the zipper elements is disposed for mating engagement with a corresponding zipper element adjacent an edge of an adjoining curtain section.

A sixth aspect of the present invention relates to a lower boom curtain section that includes: one or more sheets of flexible material that allow the flow of water therethrough, the one or more sheets of flexible material having an upper edge, a lower edge, and opposed lateral edges, the lower edge being adapted and configured for connection to an anchor or ballast; and zipper elements secured to the one or more sheets of flexible material adjacent a portion of the length of both lateral edges and the upper edge, wherein each of the zipper elements is disposed for mating engagement with a corresponding zipper element adjacent an edge of an adjoining curtain section.

A seventh aspect of the present invention relates to a main boom curtain section formed of one or more sheets of flexible material that allow the flow of water therethrough and having upper and lower edges and opposed lateral edges, the boom curtain section including a first zipper element secured to the one or more sheets of flexible material adjacent a portion of the length of both lateral edges and the upper and lower edges, wherein the first zipper element adjacent the lateral edges and upper and lower edges are disposed for mating engagement with a corresponding zipper element adjacent an edge of an adjoining curtain section.

An eight aspect of the present invention relates to a boom curtain including two or more upper curtain sections, two or more lower curtain sections, and two or more main curtain sections connected together to form a boom curtain.

A ninth aspect of the present invention relates to a boom system including a boom curtain according to the eighth aspect of the present invention. Specifically, the boom system can include a support system which can be positioned in a body of water, wherein the two or more upper curtain sections are connected to the support system; and means, connected to the two or more lower curtain sections, for maintaining at least the lower edges thereof substantially against the floor of a body of water upon introduction of the boom system into the body of water.

A tenth aspect of the present invention relates to a method of assembling a boom system including: assembling a boom curtain according to the ninth aspect of the present invention by connecting together mating zipper elements from adjacent curtain sections; connecting each upper curtain section to a support system which can be positioned in a body of water; and connecting each lower curtain section to means for maintaining the lower edges thereof substantially against the floor of a body of water upon introduction of the boom system into the body of water.

Because the different sections of the boom curtain, whether a single curtain section according to the first aspect of the present invention or modular curtain sections according to the fifth, sixth, or seventh aspects of the present invention, are readily connected or disconnected from one another, the configuration of the boom curtain can be adjusted during assembly or repair for particular demands of the site where the boom itself is installed. This overcomes numerous difficulties which can be encountered during installation of the boom for the first time, as well as numerous difficulties which can be encountered during boom curtain repair. For example, the entire boom curtain no longer needs to be replaced or repaired by removing the entire boom (or part thereof) from the body of water in which it is deployed. Instead, only a portion in need of repair is removed and then replaced. This can significantly decrease the amount of time and effort required to effect such a repair, providing significant cost saving both in materials and labor. As a result of time savings, it may be possible to minimize the shutdown of systems which require use of the boom (i.e., such as water intake systems).

Thus, the boom is relatively simple to assemble, providing fewer failure points, faster deployment, less on-site equipment, lower on-site labor requirements, and safer assembly conditions. Other advantages of the invention include flexibility and increased ability to customize boom systems using modular components.

DETAILED DESCRIPTION OF THE INVENTION

Figure 1:
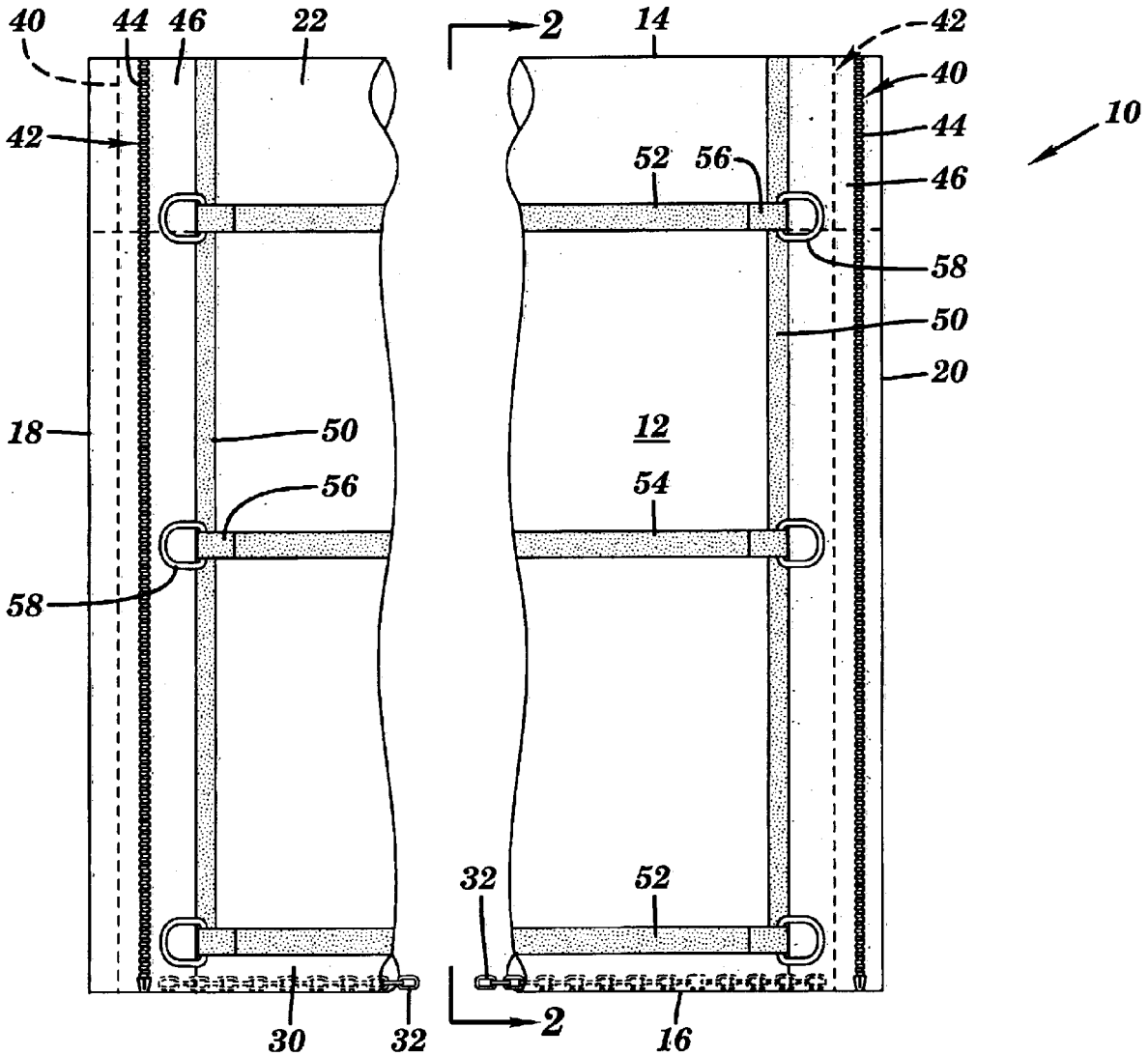
FIG. 1 is a side elevational view of a boom curtain section according to one embodiment of the present invention.

Boom curtains for use in containment/exclusion boom systems are assembled from modular components connected together via zipper connections. The boom curtains are assembled from various boom curtain sections. As described in greater detail below, the boom curtain sections can be prepared such that each boom curtain section has a predetermined height, but different curtain sections (of various lengths) can be connected together to extend the length of the boom curtain. Boom curtains of this type include zipper elements adjacent lateral edges thereof to enable connection of adjoining curtain sections to one another. Alternatively, modular boom curtain sections can include different upper boom curtain sections adapted for connection to different support systems of a containment/exclusion boom; different lower boom curtain sections adapted for connection to different anchors or ballast designs as well as accommodating different environmental conditions (e.g., current flow); and different main curtain sections adapted for different environmental conditions. Boom curtain sections of this type include zipper elements adjacent all edges which are intended to be connected to an adjoining curtain section.

The flexible fabric used to construct the boom curtain sections is preferably a geosynthetic fabric or geotextile material, which can be either woven or non-woven. For most applications, it is sufficient to construct the boom curtain sections with a single layer of geosynthetic fabric. However, for some applications, a multilayer construction may be desirable to provide added strength or protection against abrasion. When more than one layer is employed, the layers can be of the same geosynthetic fabric or different fabrics. For instance, a curtain might have a first layer of nonwoven fabric and a second layer of a woven fabric, which would tend to be more abrasive-resistant than the nonwoven fabric. The fabric can optionally be custom designed to provide for greater or lesser water flow therethrough, as described in U.S. patent application Ser. No. 09/168,491 to Gunderson et al., which is hereby incorporated by reference in its entirety.

The geosynthetic fabric is "hydrophobic" or "water-pervious," meaning that water passes through the fabric. The hydrophobic property of geosynthetic fabric permits the passage of water current through the curtain section formed of such fabric. When geosynthetic fabrics are used entirely for the boom curtain sections in a boom system, the ability to allow passage of water current has the effect of maintaining the relative shape and position of the boom even in adverse current conditions. It also facilitates towing of the boom system or boom curtain, if and when necessary.

In certain embodiments, the geosynthetic fabric can be "oleophilic," meaning that it absorbs or attracts oil, thereby blocking the flow of oil. For containment of silt and other suspended particulates, it is not essential that the curtain be oleophilic; obviously, for containment of oil, the curtain preferably is oleophilic. Useful geosynthetic fabrics are further characterized by high load distribution capacity and the ability to abate material filtration. Geosynthetic fabrics are commercially available in a range of tensile strengths, permeabilities, and permitivities, and are useful for the purposes of the invention throughout those ranges.

The geosynthetic fabrics are generally nonbiodegradable, so they do not deteriorate due to environmental exposure. During prolonged use, exposure to ultraviolet (UV) light may cause some geosynthetic fabrics to weaken or deteriorate. However, UV-resistant fabrics are commercially available as well as UV resistance treatment methods.

Geosynthetic fabric may be prepared using one or a combination of various polymers, for example polyester, polypropylene, polyamides, and polyethylene. Most commercially available geosynthetic fabrics are polypropylene or polyester. Examples of suitable nonwoven geosynthetic fabrics include, but are not limited to, AMOPAVE® 4399, AMOPAVE® HD 4597, 4545, 4553, and 4561 (all polypropylene fabrics commercially available from Amoco Fabrics and Fibers Company); Typar®, a polypropylene fabric commercially available from Dupont; TREVIRA® Spunbond, a polyester fabric commercially available from Hoechst Fibers Industries. Examples of suitable woven geosynthetic fabrics include, but are not limited to, 1380 SILT STOP®, 1198, 1199, 2090, 2000, 2006 (all polypropylene fabrics commercially available from Amoco Fabrics and Fibers Company).

When assembling a boom curtain from two or more boom curtain sections, the geosynthetic fabric used to form the curtain sections can be the same for each curtain section or different.

In addition to the curtain, boom systems also include support systems that support the boom curtain while it is installed in the water environment. A number of different support systems can be employed, including floating support systems and permanent or semi-permanent support systems.

Floating support systems can include a plurality of conventional flotation units usable with the present invention, such as inflatable devices, air bags, and floats made from buoyant materials, such as cork, synthetic foams, and other plastics. However, conventional devices may not perform adequately under adverse conditions. It has been found that under adverse conditions, expanded polystyrene ("EPS") is especially suitable for use as the flotation unit. It is desirable to coat or seal the EPS to prevent deterioration associated with prolonged exposure to the elements. EPS is commercially available from ARCO Chemical Company as DYLITE® and can be formed or molded into flotation units of various sizes and shapes (e.g., cylindrical, square, etc.) as required by project design. The EPS has a positive buoyancy that keeps the flotation unit substantially above the water surface at all times, allowing the flotation unit to ride the waves, even in adverse conditions. An EPS flotation unit is not deformed by wave action and does not lose buoyancy if punctured, as would an inflatable device. A single cubic foot of EPS can support as much as 60 lbs. A commonly used size of flotation unit of EPS is an 8" to 12" diameter cylindrical configuration, but the size can be readily adapted to meet specific wave and environmental conditions and depth requirements.

Depending upon the circumstances of the installation, a permanent or semi-permanent support system can be used rather than the floating support system afforded by use of the EPS or other buoyant materials. Such permanent or semi-permanent support systems can include pilings of conventional construction and horizontal support members (i.e., a wire, beam, catwalk, or other like support) which extend between adjacent pilings. The boom curtain can be connected to either the horizontal support members or both the horizontal support members and the pilings. These alternative support systems are described in U.S. patent application Ser. No. 09/168,491 to Gunderson et al., which is hereby incorporated by reference in its entirety. To connect the boom curtain to horizontal support members, the upper edge of the boom curtain is typically provided with a plurality of grommets or other reinforcements and then suspended from a turnbuckle or the like spanning between the curtain and the horizontal support member. The use of turnbuckles is disclosed in U.S. patent application Ser. No. 09/989,219 to Dreyer et al., which is hereby incorporated by reference in its entirety.

When the boom curtain is utilized to prepare a containment/exclusion boom, the boom curtain can also be connected to an anchoring system or ballast which is designed to maintain at least the bottom portion of the boom curtain substantially against the floor of a body of water.

Ballasts such as lengths of steel chain (from less than ⅛ inch to over ¾ inch) and steel cable (from less than ¾ inch to over 1½ inches in diameter) have been used. Of course, chains and cables of greater or less diameter may be used to meet the specific requirements of a project design. The ballast can be received within a portion of the boom curtain sections or otherwise connected to the lower edge thereof (e.g., tied with wire or other means).

In adverse wave and current conditions, the ballast alone may not be sufficient to maintain the containment boom in place or the curtain in a substantially vertical orientation. It would therefore be desirable to employ an anchor or a series of anchors to secure the boom in place. The anchors can be attached to the bottom of the curtain or to the ballast. For booms of considerable length, anchors preferably are attached at regular intervals. Anchor location may be marked by brightly colored buoys, as necessary.

Figure 2:
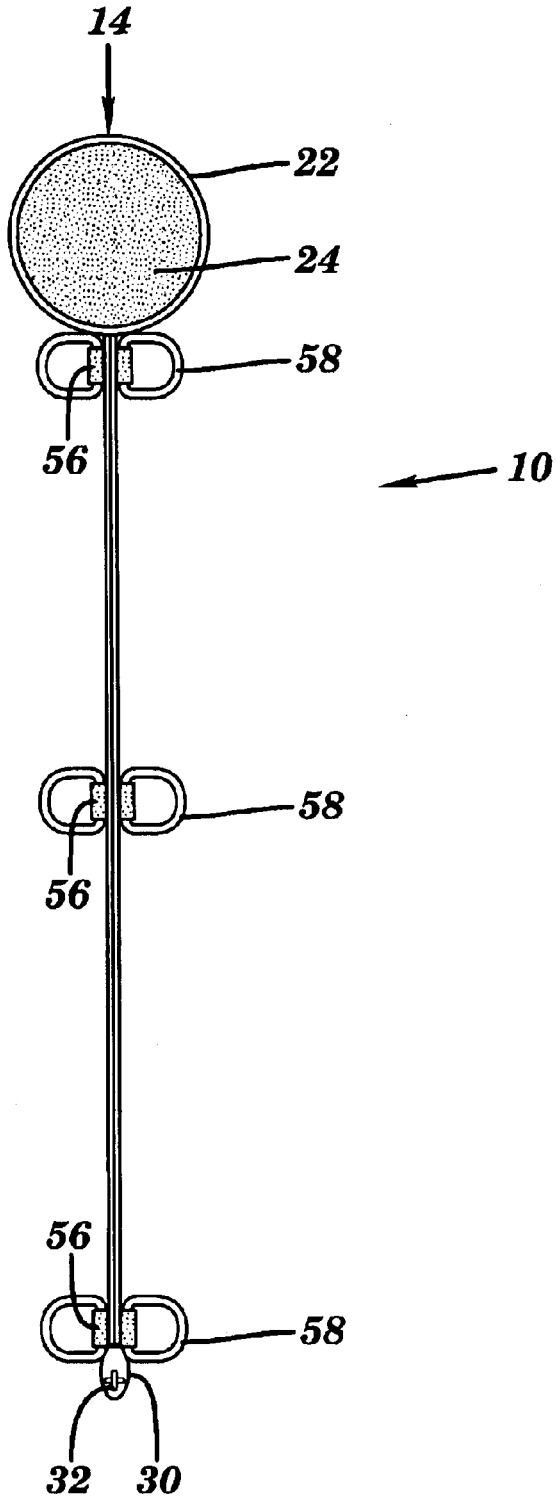
FIG. 2 is a cross-sectional view of the boom curtain according to line 2—2 in FIG. 1.

Referring now to FIGS. 1 and 2, a boom curtain section 10 in accordance with a first aspect of the present invention is shown. The boom curtain section 10 is formed of one or more sheets of a flexible material 12 that allows the flow of water therethrough, such as a geosynthetic fabric of the type described above. The boom curtain section includes an upper edge 14, a lower edge 16, and opposite lateral edges 18,20.

At the upper edge 14, a sleeve 22 is formed by folding the sheet of flexible material over and securing its free end to the sheet of material by sewing, heat fusion, or other form of connection. Within sleeve 22 is received a substantially cylindrical flotation unit 24, preferably formed of EPS as described above.

At the lower edge 16, a sleeve 30 is formed by similarly folding the sheet of flexible material over and securing its free end to the sheet of material by sewing, heat fusion, or other form of connection. Within sleeve 30 is received a ballast chain 32 of the type described above.

At each of the lateral edges 18,20, a pair of zipper elements 40,42 are secured to the sheet of material on its opposite faces. The zipper elements 40,42 extend at least a portion of the length of both lateral edges, and preferably (as shown) substantially the entire length of both lateral edges. Each of the zipper elements 40,42 includes a set of zipper teeth 44 attached to a strip of material 46, which is the portion of the zipper element that is actually secured to the sheet of flexible material 12 by sewing, heat fusion, or other form of connection. The zipper elements are preferably formed of sufficiently durable materials that will resist deterioration in a marine environment, such as a thermoplastic material. Suitable zipper elements are commercially available from a variety of vendors (including BSM Trading SRL). The material 46 is preferably a reinforced geomembrane that is suitable to withstand the marine environment. One such geomembrane, known as XR-5, is available from Seaman Corporation (Wooster, Ohio).

The zipper elements 40,42 are secured to the sheet of flexible material 12 such that the two zipper elements at each lateral edge 18,20 of the curtain section effectively sandwich the sheet of flexible material 12 therebetween. Moreover, the two zipper elements 40,42 are secured to the sheet of flexible material such that their sets of teeth 44 are recessed the respective lateral edge. The set of teeth for zipper element 40 is recessed a first distance from a respective lateral edge and the set of zipper teeth for the second zipper element 42 is recessed a second distance from the same lateral edge. As shown, the second distance is greater than the first distance. As discussed more fully hereinafter, when two adjoining curtain sections are connected together, the first zipper element from one curtain section is connected to the second zipper element from the adjoining curtain section and vice versa. One of the two zipper elements (either the first or the second) includes the zipping mechanism.

By recessing the sets of teeth from the lateral edge 18,20, the sheet of flexible material 12 is allowed to extend beyond the zipper elements. As discussed more fully hereinafter, this allows the sheets of flexible material 12 from two adjoining curtain sections 10 to overlap after the first and second zipper elements from adjoining lateral edges have been connected together.

To reinforce the connection between the strip of material 46 on the zipper elements and the sheet of flexible material 12, a strip of nylon webbing 50 is connected to both sides of the curtain section 10 such that it overlies their connection. The nylon webbing 50 is connected by sewing, heat fusion, or other suitable form of connection.

To reinforce the connections used to form the upper and lower sleeves, a strip of nylon webbing 52 is connected to both sides of the curtain section 10 such that it overlies their connections. The nylon webbing 52 is connected by sewing, heat fusion, or other suitable form of connection. A second strip of nylon webbing 54 is optionally connected to both sides of the curtain section at a location intermediate the strips of nylon webbing 52. The nylon webbing 54 is similarly connected by sewing, heat fusion, or other suitable form of connection. At the ends of each strip of nylon webbing 52,54, a loop 56 is formed to secure a D-ring 58 or other suitable link element. Thus, each lateral edge has two or more D-rings 58 secured to each side of the curtain section 10.

Figure 3:
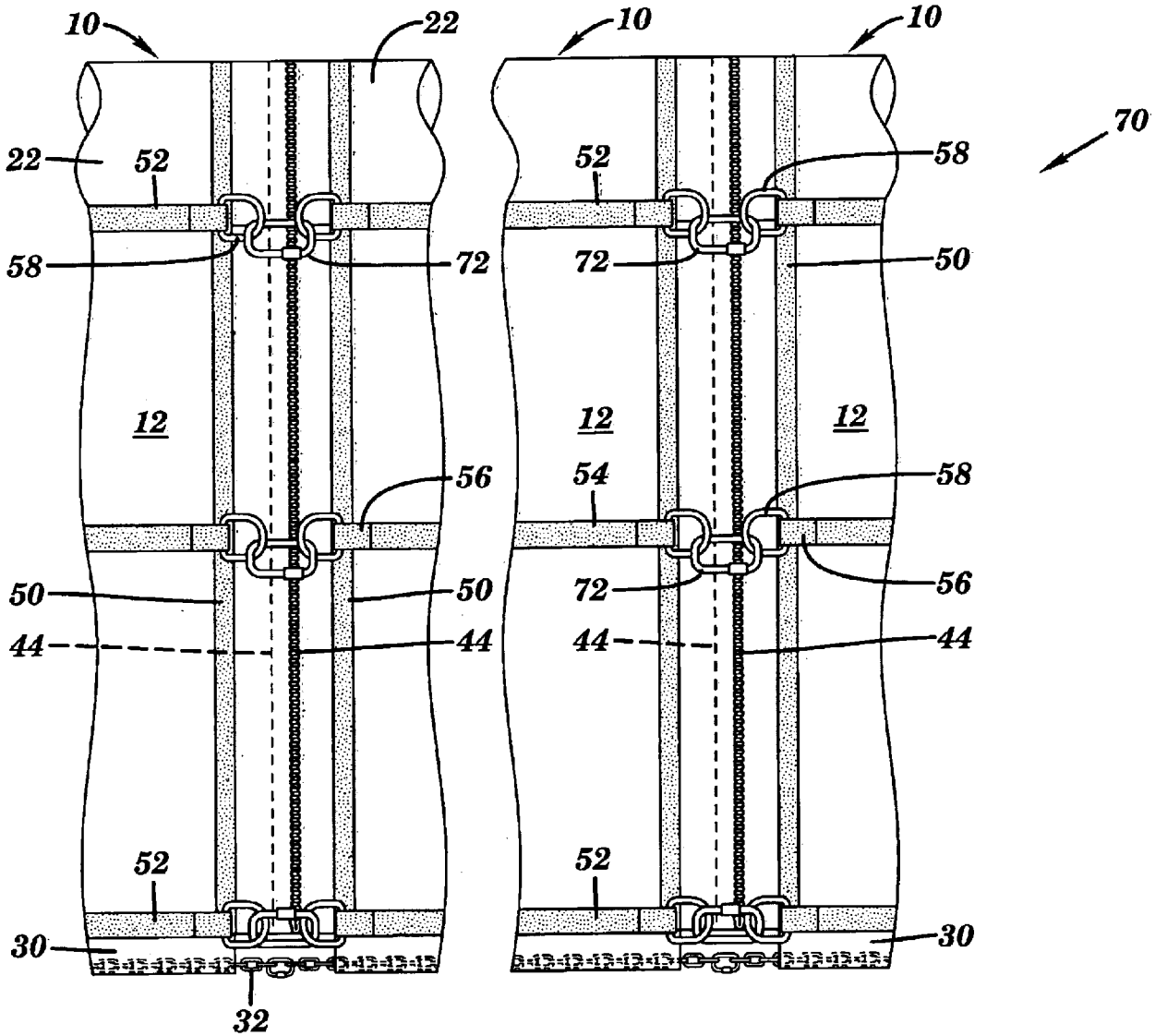
FIG. 3 is a side elevational view showing the curtain section illustrated in FIG. 1 with its zipper elements on the lateral edges connected to the zipper elements on the lateral edges of two adjoining curtain sections, forming a portion of a boom curtain.

As shown in FIG. 3, two or more curtain sections 10 are intended to be coupled together to form a boom curtain 70.

Figure 4:
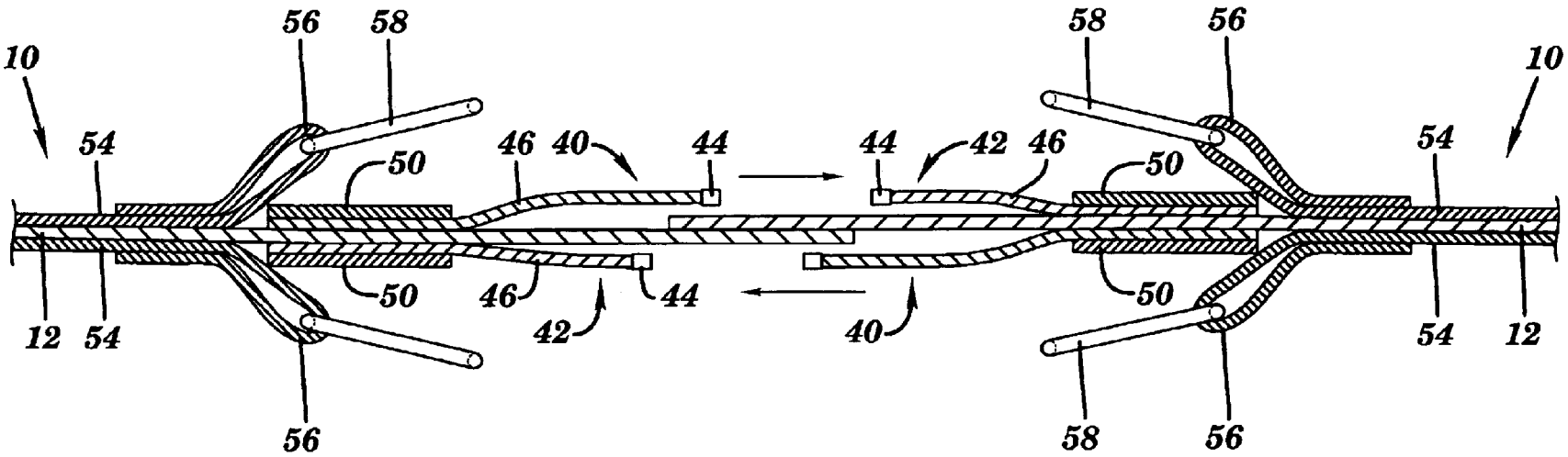
FIG. 4 is a partial cross sectional view showing two curtains sections whose lateral edges are shown being brought together for connection of the respective zipper elements. The two curtains sections are being moved in the direction of the arrows.
Figure 5:
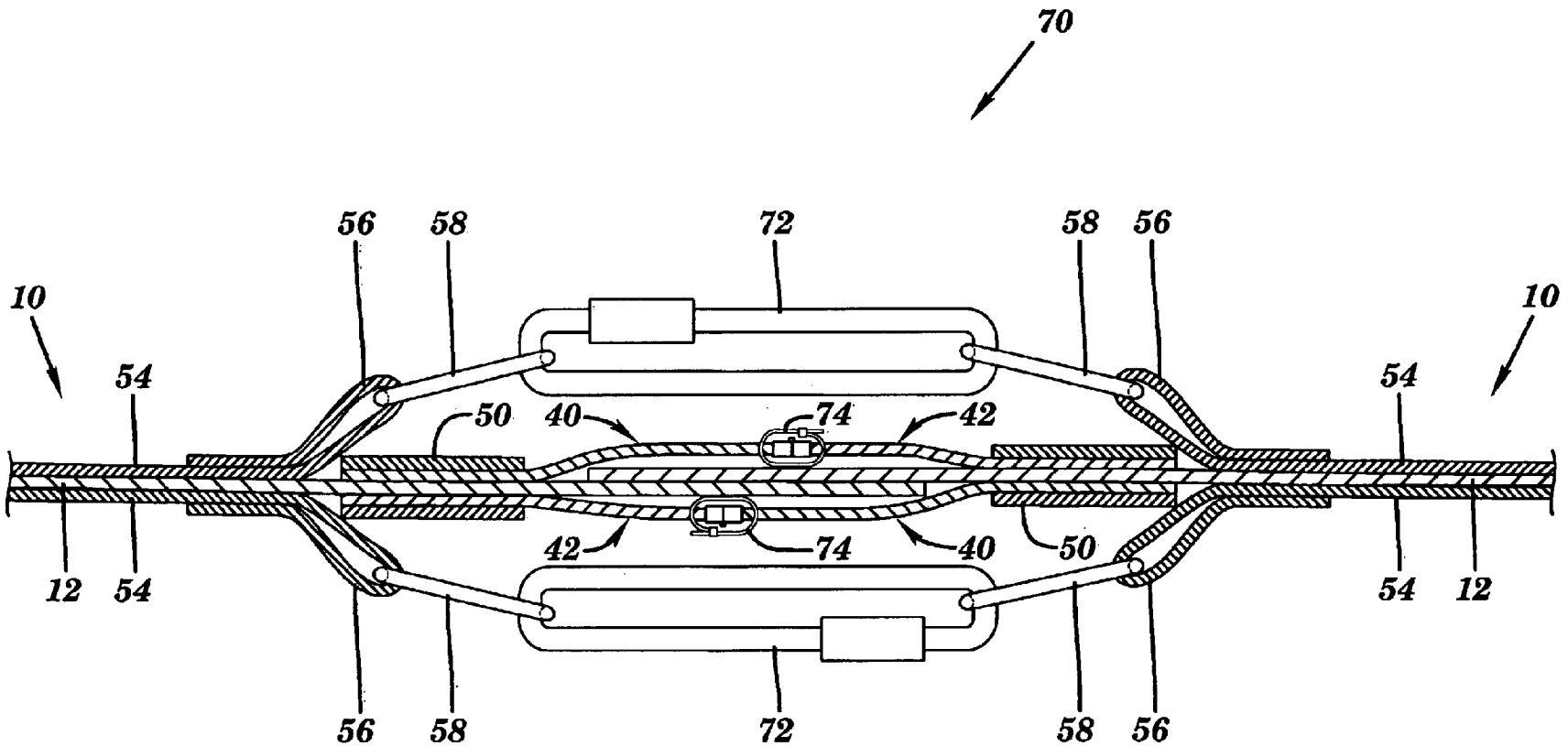
FIG. 5 is a partial cross sectional view showing the two curtain sections of FIG. 4 with the zipper elements from the adjoining lateral edges of the two curtain sections connected together. The zipper connections have been reinforced with a Q-lock and tie straps to prevent damage to the zipper connections under stress of use.
Figure 6:
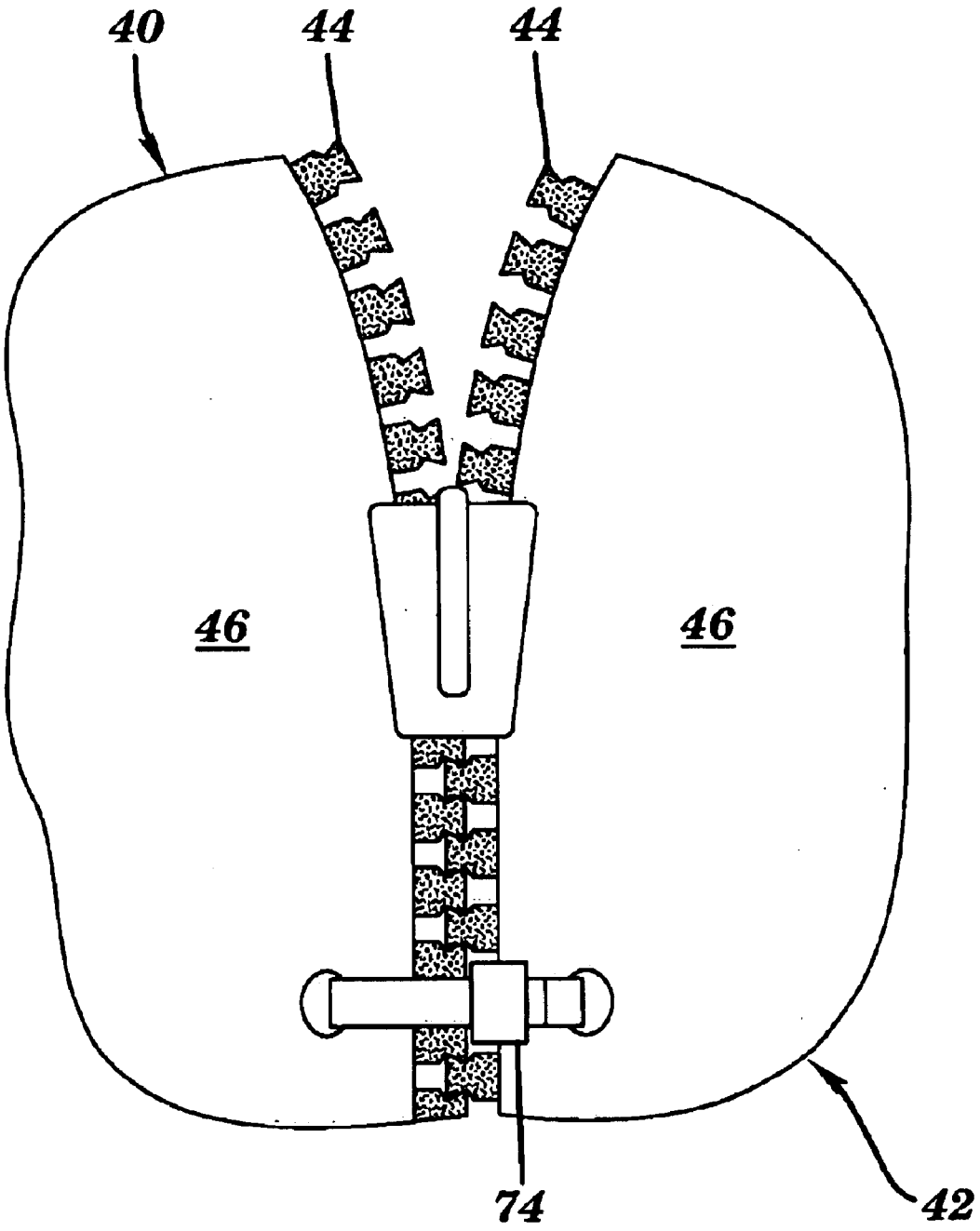
FIG. 6 is an enlarged view of a zipper connection formed between two adjoining curtain sections. A tie strap is shown bridging the zipper connection for its reinforcement.

Referring now to FIGS. 4–6, assembly of a boom curtain 70 basically involves connecting together the zipper element (s) adjacent a lateral edge from each curtain section with a corresponding zipper element adjacent a lateral edge of an adjoining curtain section. Adjoining lateral edges of the two boom curtain sections 10 are brought together (i.e., in the direction of the arrows shown in FIG. 4) such that the sheets of flexible material 12 from the two adjoining curtain sections overlap. Thereafter, the zipper connections are formed by zipping together the first and second zipper elements 40,42 in mating engagement. To reinforce the zipper connections, suitable connectors 72, such as Q-links, link together the D-rings 58 from adjoining curtain sections. To further reinforce the zipper connections, a plurality of tie-straps 74 can be used along the full height of the boom curtain. The tie-straps 74 are of conventional design, having a toothed tongue and a locking element on one end thereof. The tongue is passed through small openings 76 formed through the strips of material 46 for the zipper elements and the sheet of flexible material 12, and then passed through its locking element. The tongue can thereafter be cut to prevent it from catching or snagging during deployment. As shown in FIG. 6, the tie-strap, once installed, effectively surrounds a zipper connection.

Because every boom curtain has opposite ends, for savings in material and construction costs it is desirable to provide a terminal curtain section. The terminal curtain section is like the internal curtain section 10 as described above, except that the terminal curtain section, because it only has one adjoining curtain section, is provided with zipper elements and corresponding reinforcements at only one lateral edge.

Thus, boom systems of the present invention are formed of a boom curtain as described above and a support system of the type described above as well as any ballast or anchor to hold the lower edge of the boom curtain substantially against the floor of a body of water upon introduction of the boom system therein. Assembly of the boom system involves assembling a boom curtain of the present invention by connecting together mating zipper elements from adjoining curtain sections as described above, connecting the upper edge of each curtain section to a support system which can be positioned in a body of water, and connecting the lower edge of each curtain section to anchors or ballast for maintaining at least the lower edges thereof substantially against the floor of a body of water upon introduction of the boom system into the body of water. In one embodiment, the connecting of the boom curtain to the support system or the anchors or ballast is carried out prior to curtain assembly. In another embodiment, the connecting of the boom curtain to the support system or the anchors or ballast is carried out following curtain assembly. As shown in FIG. 3, Q-links 72 can also be used to connect lengths of ballast chain 32 positioned within the sleeve 30 of adjacent curtain sections 10.

While the boom curtain section as described above are formed with vertical zipper connections, in another embodiment of the present invention the boom curtain sections are formed with both vertical and horizontal zipper connections. With horizontal zipper connections, it becomes possible to customize boom curtain configurations for the type of environment is which that will be used as well as to adjust for changes in types of support systems and boom curtain height.

A main curtain section is formed of one or more sheets of flexible material that allow the flow of water therethrough and has upper and lower edges and opposed lateral edges. The main curtain section also includes a zipper element secured to the one or more sheets of flexible material adjacent a portion of the length of both lateral edges and the upper and lower edges, wherein the zipper element adjacent the lateral edges and upper and lower edges are disposed for mating engagement with a corresponding zipper element adjacent an edge of an adjoining curtain section.

An upper curtain section is formed of one or more sheets of flexible material that allow the flow of water therethrough and has an upper edge, a lower edge, and opposed lateral edges. The upper curtain section includes an upper edge that is adapted and configured for connection to a support system of the type described above. According to one embodiment, the upper curtain section is provided with a sleeve formed at the upper edge thereof to receive a flotation unit of the type described above, while other embodiments can include a series of grommets for receiving a turnbuckle or the like. The upper curtain section also includes zipper elements secured to the one or more sheets of flexible material adjacent a portion of the length of both lateral edges and the lower edge, wherein each of the zipper elements is disposed for mating engagement with a corresponding zipper element adjacent an edge of an adjoining curtain section.

A lower curtain section is formed of one or more sheets of flexible material that allow the flow of water therethrough and has an upper edge, a lower edge, and opposed lateral edges. The lower curtain section has a lower edge that is adapted and configured for connection to an anchor or ballast of the type described above. According to one embodiment, the lower curtain section has a sleeve formed at the lower edge thereof to receive a ballast of the type described above, while other embodiments can include a plurality of grommets for receiving a connector that is coupled to an anchor or ballast. The lower curtain section also includes zipper elements secured to the one or more sheets of flexible material adjacent a portion of the length of both lateral edges and the upper edge, wherein each of the zipper elements is disposed for mating engagement with a corresponding zipper element adjacent an edge of an adjoining curtain section.

In one preferred embodiment, the lower curtain section is in the form of a Y-panel curtain section or bottom portion as disclosed in U.S. patent application Ser. No. 10/134,359 to Dreyer, which is hereby incorporated by reference in its entirety.

For all of the upper, lower, and main curtain sections, the one or more sheets of flexible fabric is preferably a geosynthetic fabric of the type described above, which geosynthetic fabric can be the same for each section or different for various sections. When more than one sheet of geosynthetic fabric is utilized, the two sheets can be the same or different. In addition, the zipper connections for the upper, lower, and main curtain sections are preferably of the type described above in connection with the first embodiment.

Figure 7:
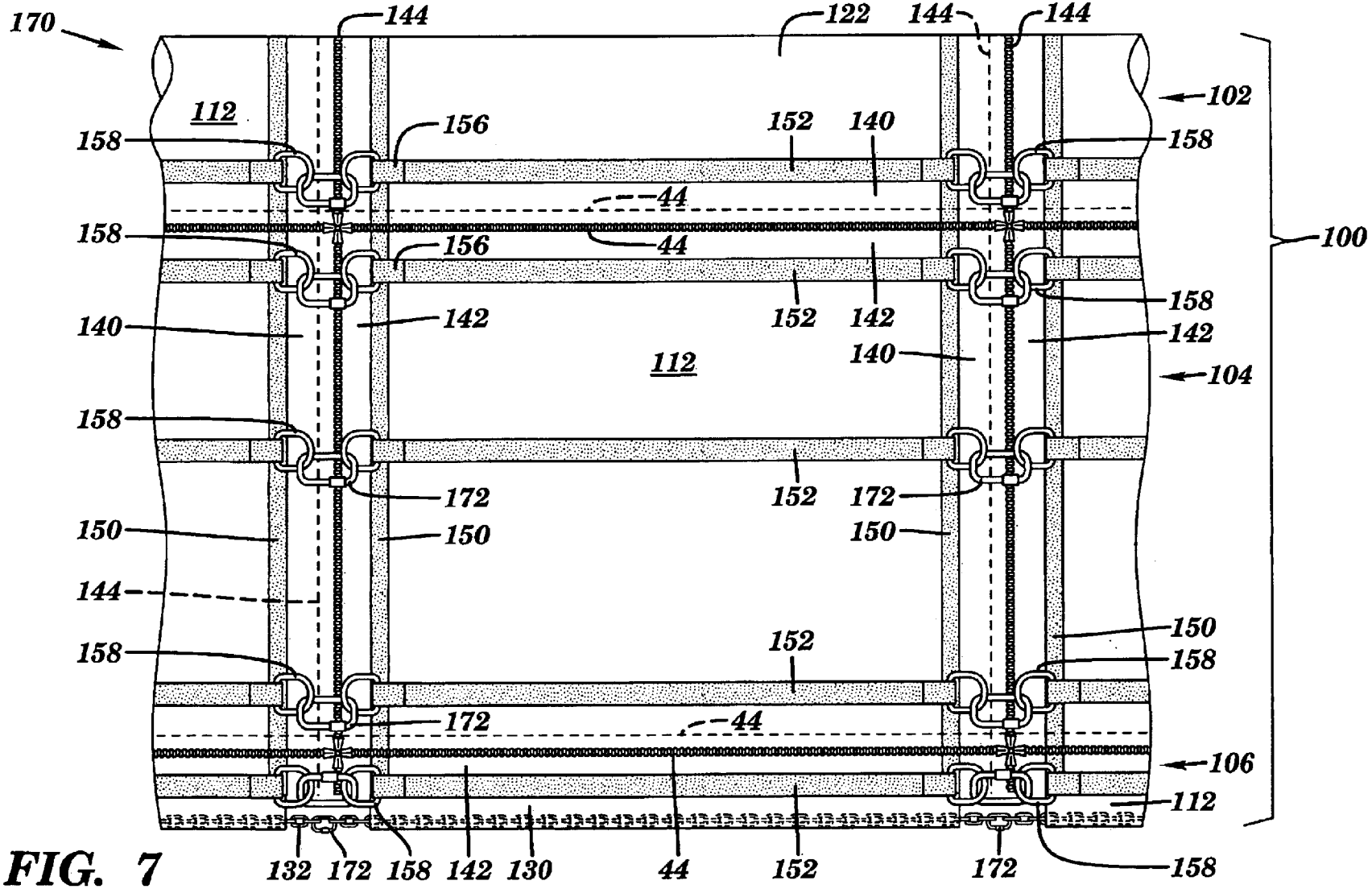
FIG. 7 is a side elevational view of a second embodiment of the present invention showing multiple upper curtain sections, multiple main curtain sections, and multiple lower curtain sections coupled together by horizontal and vertical zipper connections.

Referring now to FIG. 7, a boom curtain 100 (partially shown) is assembled from three upper curtain sections 102, three main curtain sections 104, and three lower curtain sections 106. Fewer or more curtain sections can also be provided. In this particular embodiment, the upper curtain section includes a sleeve 122 formed at its upper edge for receiving a flotation unit and the lower curtain section includes a sleeve 130 formed at its lower edge for receiving a ballast 132. Each upper curtain section has adjacent its lateral and lower edges a pair of zipper elements 140,142 of the type described above; each main curtain section has adjacent its upper, lower, and lateral edges a pair of zipper elements 140,142 of the type described above; and each lower curtain section has adjacent its upper and lateral edges a pair of zipper elements 140,142 of the type described above. To facilitate the four-way intersection the overlapping fabric material 112 forming the various sections can be cut or otherwise cornered so as not to interfere therewith. Each of the upper, main, and lower curtain sections is provided with a vertical strip of nylon webbing 150 and a horizontal strip of nylon webbing 152 to reinforce the connection between the zipper elements 140,142 and the material 112. In addition, the horizontal straps terminate in a loop 156 that retains a D-ring 158. Q-links 172 span between corresponding D-rings 158 to minimize any strain applied to the zipper connections. Although not shown in FIG. 7, tie straps (as shown in FIG. 6) can additionally be used across the various horizontal and/or vertical zipper connections. Assembly of the boom system shown in FIG. 7 is accomplished in much the same way as described above with respect to the embodiment shown in FIG. 4 except that additional zipper connections are made and additional Q-links and tie straps can be used to reinforce the zipper connections.

Though the boom system 170 illustrated in FIG. 7 is assembled using flotation units as the support system and chain as ballast, it should be appreciated that any of a variety of supports systems as well as anchors and/or ballast of the type described above can be utilized with modifications to the upper and lower curtain sections as described above.

Other relevant parameters for the boom curtain include, but are not limited to, water depth, particulate size, length of time the boom is to be in place, pollutant composition, and the availability of manpower and equipment.

The boom curtains of the present invention can also include one or more tow cords secured to the curtain. The tow cords are used to tow the boom into position or from one location to another. The two cords can be bands or strips of nylon lifting straps, steel or aluminum cable, polypropylene rope, geosynthetic material, or the like that extend the length of the curtain and can be secured to the curtain or portions thereof in a manner disclosed in U.S. Pat. No. 5,102,261 to Gunderson, which is hereby incorporated by reference in its entirety. Depending on the overall length of the curtain and other design parameters, additional tow cords may be positioned on the curtain or portions thereof as necessary.

The boom system can be deployed from a barge, a dock with a small boat, or other surface or access point near the water. The invention is uncomplicated in design and can be easily deployed by persons having basic waterfront experience without prior training in containment boom deployment.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed is:

1. A boom curtain section comprising:

one or more sheets of flexible material that allow the flow of water therethrough, the one or more sheets of flexible material having an upper edge, a lower edge, and opposed lateral edges; and a first zipper element adjacent a portion of the length of each lateral edge, each of the first zipper elements comprising a set of zipper teeth attached to a strip of material, the strip of material being secured to the one or more sheets of flexible material with the set of zipper teeth recessed from its adjacent lateral edge, whereby upon mating engagement of the zipper teeth on the first zipper element adjacent one lateral edge with a corresponding zipper element adjacent a lateral edge of an adjoining curtain section, the boom curtain section and the adjoining curtain section overlap.

2. The boom curtain section according to claim 1 wherein the one or more sheets of flexible material comprise woven or non-woven geotextile materials.

3. The boom curtain section according to claim 1 wherein each of the first zipper elements extends substantially the entire length of its adjacent lateral edge.

4. The boom curtain section according to claim 1 further comprising:

a second zipper element adjacent a portion of the length of each lateral edge, each of the second zipper elements comprising a set of zipper teeth attached to a strip of material, the strip of material being secured to the one or more sheets of flexible material with the set of zipper teeth recessed from its adjacent lateral edge.

5. The boom curtain section according to claim 4 wherein at each lateral edge of the boom curtain section, the one or more sheets of flexible material are sandwiched between the first and second zipper elements.

6. The boom curtain section according to claim 4 wherein the set of zipper teeth for the first zipper element is recessed a first distance from each lateral edge and the set of zipper teeth for the second zipper element is recessed a second distance from each lateral edge.

7. The boom curtain section according to claim 1 further comprising:

first link elements secured to the one or more sheets of flexible material adjacent both lateral edges thereof and on one side thereof.

8. The boom curtain section according to claim 7 further comprising:

second link elements secured to the one or more sheets of flexible material adjacent both lateral edges thereof and on an opposite side thereof.

9. The boom curtain section according to claim 1 further comprising a sleeve formed along the upper edge thereof.

10. The boom curtain section according to claim 1 further comprising a sleeve formed along the lower edge thereof.

11. A boom curtain comprising two or more curtain sections according to claim 1, wherein the zipper element adjacent a lateral edge of each curtain section is engaged with a corresponding zipper element adjacent a lateral edge of an adjoining curtain section.

12. The boom curtain according to claim 11 wherein the one or more sheets of flexible material in each curtain section is formed of a material that is the same or different.

13. The boom curtain according to claim 12, wherein the one or more sheets of flexible material in each curtain section is formed of a material that is the same and each comprises woven or non-woven geotextile materials.

14. The boom curtain according to claim 11 wherein each of the zipper elements for each curtain section extends substantially the entire length of its adjacent lateral edge.

15. The boom curtain according to claim 11 further comprising:

a terminal curtain section having upper and lower edges and opposed lateral edges, and comprising one or more sheets of flexible material that allow the flow of water therethrough and a zipper element secured to the one or more sheets of flexible material adjacent a portion of the length of only one lateral edge, wherein the zipper element adjacent the one lateral edge is engaged with a corresponding zipper element adjacent a lateral edge of an adjoining curtain section.

16. The boom curtain according to claim 15 wherein the zipper element adjacent the one lateral edge of the terminal curtain section extends substantially the entire length of the one lateral edge.

17. The boom curtain according to claim 15 where the boom curtain comprises two terminal curtain sections.

18. The boom curtain according to claim 11 wherein each of the two or more curtain sections further comprise:

a second zipper element adjacent a portion of the length of each lateral edge, each of the second zipper elements comprising a set of zipper teeth attached to a strip of material, the strip of material being secured to the one or more sheets of flexible material with the set of zipper teeth recessed from its adjacent lateral edge wherein the first zipper element from one curtain section is engaged with the second zipper element from the adjacent curtain section.

19. The boom curtain according to claim 18 wherein at each lateral edge of each of the two or more boom curtain sections, the one or more sheets of flexible material are sandwiched between the first and second zipper elements.

20. The boom curtain according to claim 18 wherein on each of the two or more boom curtain sections, the set of zipper teeth for the first zipper element is recessed a first distance from each lateral edge and the set of zipper teeth for the second zipper element is recessed a second distance from each lateral edge, whereby the first and second zipper elements from one curtain section are positioned for mating engagement with the second and first zipper elements, respectively, from the adjacent curtain section.

21. The boom curtain according to claim 11 wherein each of the two or more curtain sections comprises first link elements secured to the one or more sheets of flexible material adjacent both lateral edges of the one or more sheets of flexible material and on one side thereof, and the boom curtain further comprises:

first connectors spanning between the first link elements of two adjacent curtain sections.

22. The boom curtain according to claim 21 wherein each of the two or more curtain sections comprises second link elements secured to the one or more sheets of flexible material adjacent both lateral edges thereof, and the boom curtain further comprises:

second connectors spanning between the second link elements of two adjacent curtain sections.

23. The boom curtain according to claim 22 wherein the first and second connectors are Q links.

24. The boom curtain according to claim 11 further comprising:

a tie strap that passes through the one or more sheets of flexible material of two adjacent curtain sections to surround a zipper connection.

25. A boom system comprising a boom curtain according to claim 11.

26. The boom system according to claim 25 further comprising:

a support system which can be positioned in a body of water, wherein the upper edge of the two or more curtain sections are connected to the support system.

27. The boom system according to claim 25 further comprising:

means, connected to the lower edge of the two or more curtain sections, for maintaining at least the lower edges thereof substantially against the floor of a body of water upon introduction of the boom system into the body of water.

28. A method of assembling a boom system comprising:

assembling a boom curtain according to claim 11 by connecting together mating zipper elements from adjoining curtain sections;

connecting the upper edge of each curtain section to a support system which can be positioned in a body of water; and connecting the lower edge of each curtain section to means for maintaining at least the lower edges thereof substantially against the floor of a body of water upon introduction of the boom system into the body of water.

29. The method according to claim 28 wherein each said connecting is carried out prior to said assembling.

30. The method according to claim 28 wherein each said connecting is carried out after said assembling.

31. The boom curtain section according to claim 1 further comprising a zipper element secured to the one or more sheets of flexible material adjacent a portion of the length of the upper edge.

32. The boom curtain section according to claim 31 further comprising a zipper element secured to the one or more sheets of flexible material adjacent a portion of the length of the lower edge.

33. The boom curtain section according to claim 1 further comprising a zipper element secured to the one or more sheets of flexible material adjacent a portion of the length of the lower edge.

34. A boom curtain section comprising:

one or more sheets of flexible material that allow the flow of water therethrough, the one or more sheets of flexible material having an upper edge, a lower edge, and opposed lateral edges, the upper edge being adapted and configured for connection to a support system, and a first zipper element adjacent a portion of the length of each lateral edge and the lower edge, each of the first zipper elements comprising a set of zipper teeth attached to a strip of material, the strip of material being secured to the one or more sheets of flexible material with the set of zipper teeth recessed from its adjacent lateral or lower edge, whereby upon mating engagement of the zipper teeth on the first zipper element with a corresponding zipper element adjacent an edge of an adjoining curtain section, the boom curtain section and the adjoining curtain section overlap.

35. The boom curtain section according to claim 34 wherein the one or more sheets of flexible material comprise woven or non-woven geotextile materials.

36. The boom curtain section according to claim 34 wherein each of the first zipper elements extends substantially the entire length of its adjacent lateral or lower edge.

37. The boom curtain section according to claim 34 further comprising:

a second zipper element adjacent a portion of the length of each lateral edge and the lower edge, each of the second zipper elements comprising a set of zipper teeth attached to a strip of material, the strip of material being secured to the one or more sheets of flexible material with the set of zipper teeth recessed from its adjacent lateral or lower edge.

38. The boom curtain section according to claim 37 wherein at each lateral edge and the lower edge, the one or more sheets of flexible material are sandwiched between the first and second zipper elements.

39. The boom curtain section according to claim 37 wherein the set of zipper teeth for each first zipper element is recessed a first distance from its adjacent lateral edge or lower edge and the set of zipper teeth for each second zipper element is recessed a second distance from its adjacent lateral edge or lower edge.

40. The boom curtain section according to claim 34 further comprising:

first link elements secured to the one or more sheets of flexible material adjacent both lateral edges thereof and on one side thereof.

41. The boom curtain section according to claim 40 further comprising:

second link elements secured to the one or more sheets of flexible material adjacent both lateral edges thereof and on an opposite side thereof.

42. A boom curtain section comprising:

one or more sheets of flexible material that allow the flow of water therethrough, the one or more sheets of flexible material having an upper edge, a lower edge, and opposed lateral edges, the lower edge being adapted and configured for connection to an anchor or ballast; and a first zipper element adjacent a portion of the length of each lateral edge and the upper edge, each of the first zipper elements comprising a set of zipper teeth attached to a strip of material, the strip of material being secured to the one or more sheets of flexible material with the set of zipper teeth recessed from its adjacent lateral or upper edge, whereby upon mating engagement of the zipper teeth on the first zipper elements with a corresponding zipper element adjacent an edge of an adjoining curtain section, the boom curtain section and the adjoining curtain section overlap.

43. The boom curtain section according to claim 42 wherein the one or more sheets of flexible material comprise woven or non-woven geotextile materials.

44. The boom curtain section according to claim 42 wherein each of the first zipper elements extends substantially the entire length of its adjacent lateral or upper edge.

45. The boom curtain section according to claim 42 further comprising:

a second zipper element adjacent a portion of the length of each lateral edge and the upper edge, each of the second zipper elements comprising a set of zipper teeth attached to a strip of material, the strip of material being secured to the one or more sheets of flexible material with the set of zipper teeth recessed from its adjacent lateral or upper edge.

46. The boom curtain section according to claim 45 wherein at each lateral edge and the upper edge, the one or more sheets of flexible material are sandwiched between the first and second zipper elements.

47. The boom curtain section according to claim 45 wherein the set of zipper teeth for each first zipper element is recessed a first distance from its adjacent lateral edge or upper edge and the set of zipper teeth for each second zipper element is recessed a second distance from its adjacent lateral edge or upper edge.

48. The boom curtain section according to claim 42 further comprising:

first link elements secured to the one or more sheets of flexible material adjacent both lateral edges thereof and on one side thereof.

49. The boom curtain section according to claim 42 further comprising:

second link elements secured to the one or more sheets of flexible material adjacent both lateral edges thereof and on an opposite side thereof.

50. A boom curtain comprising two or more upper curtain sections, two or more lower curtain sections, and two or more main curtain sections connected together to form a boom curtain, each upper curtain section comprising one or more sheets of flexible material that allow the flow of water therethrough, the one or more sheets of flexible material having an upper edge, a lower edge, and opposed lateral edges, the upper edge being adapted and configured for connection to a support system, and a first zipper element secured to the one or more sheets of flexible material adjacent a portion of the length of each lateral edge and the lower edge;

each main curtain section comprising one or more sheets of flexible material that allow the flow of water therethrough, the one or more sheets of flexible material having an upper edge, a lower edge, and opposed lateral edges, and a first zipper element secured to the one or more sheets of flexible material adjacent a portion of the length of each lateral edge and the upper and lower edges; and each lower curtain section comprising one or more sheets of flexible material that allow the flow of water therethrough, the one or more sheets of flexible material having an upper edge, a lower edge, and opposed lateral edges, the lower edge being adapted and configured for connection to an anchor or ballast, and a first zipper element secured to the one or more sheets of flexible material adjacent a portion of the length of each lateral edge and the upper edge;

wherein zipper elements adjacent the lower edges of the two or more upper curtain sections are connected to zipper elements adjacent the upper edges of adjoining main curtain sections, zipper elements adjacent the lateral edges of the two or more upper curtain sections are connected to zipper elements adjacent the lateral edges of adjoining upper curtain sections, zipper elements adjacent the lateral edges of the two or more main curtain sections are connected to zipper elements adjacent the lateral edges of adjoining main curtain sections, zipper elements adjacent the lower edges of the two or more main curtain sections are connected to zipper elements adjacent the upper edges of the two or more lower curtain sections, and zipper elements adjacent the lateral edges of the two or more lower curtain sections are connected to zipper elements adjacent the lateral edges of adjoining lower curtain sections.

51. The boom curtain according to claim 50 wherein the one or more sheets of flexible material are formed of a material that is the same or different for the upper curtain section, the main curtain section, and the lower curtain section.

52. The boom curtain according to claim 51 where the one or more sheets of flexible material are formed of a material that is the same for the upper curtain section, the main curtain section, and the lower curtain section, and each is a woven or non-woven geotextile materials.

53. The boom curtain according to claim 50 wherein each zipper element extends substantially the entire length of its adjacent edge.

54. The boom curtain according to claim 50 wherein each of the upper curtain sections, each of the main curtain sections, and each of the lower curtain sections further comprise second zipper element secured to the one or more sheets of flexible material adjacent a portion of the length of each edge to which a first zipper elements is adjacent.

55. The boom curtain according to claim 54 wherein each of the first and second zipper elements includes a set of zipper teeth attached to a strip of material, the strip of material being secured to the one or more sheets of flexible material at a position recessed from its adjacent edge, wherein the one or more sheets of flexible material are sandwiched between the first and second zipper elements.

56. The boom curtain according to claim 55 wherein the set of zipper teeth for each first zipper element is recessed a first distance from its adjacent edge and the set of zipper teeth for each second zipper element is recessed a second distance from its adjacent edge, whereby upon mating engagement of the first and second zipper elements from one curtain section with the second and first zipper elements, respectively, from an adjoining curtain section, the one or more sheets of flexible material of the two adjoining curtain sections overlap.

57. The boom curtain according to claim 50 wherein each of the two or more upper curtain sections, main curtain sections, and lower curtain sections comprises first link elements secured to the one or more sheets of flexible material adjacent both lateral edges thereof and on one side thereof, and the boom curtain further comprises:

first connectors spanning between the first link elements of two adjoining curtain sections.

58. The boom curtain according to claim 57 wherein each of the two or more upper curtain sections, main curtain sections, and lower curtain sections comprises second link elements secured to the one or more sheets of flexible material adjacent both lateral edges thereof and on an opposite side thereof, and the boom curtain further comprises:

second connectors spanning between the second link elements of two adjoining curtain sections.

59. The boom curtain according to claim 58 wherein the first and second connectors are Q links.

60. The boom curtain according to claim 50 further comprising:

a tie strap that passes through the one or more sheets of flexible material of two adjacent curtain sections to surround a zipper connection.

61. A boom system comprising a boom curtain according to claim 50.

62. The boom system according to claim 61 further comprising:

a support system which can be positioned in a body of water, wherein the two or more upper curtain sections are connected to the support system.

63. The boom system according to claim 61 further comprising:

means, connected to the two or more lower curtain sections, for maintaining at least the lower edges thereof substantially against the floor of a body of water upon introduction of the boom system into the body of water.

64. A method of assembling a boom system comprising:

assembling a boom curtain according to claim 50 by connecting together mating zipper elements from adjacent curtain sections;

connecting each upper curtain section to a support system which can be positioned in a body of water; and connecting each lower curtain section to means for maintaining the lower edges thereof substantially against the floor of a body of water upon introduction of the boom system into the body of water.

65. The method according to claim 64 wherein each said connecting is carried out prior to said assembling.

66. The method according to claim 64 wherein each said connecting is carried out after said assembling.

* * * * *